US005161603A

United States Patent [19]

Volkomich et al.

[11] Patent Number: 5,161,603

[45] Date of Patent: Nov. 10, 1992

[54] METHOD FOR PRODUCTION OF SINGLE-USE FOUNDRY MOLDS AND APPARATUS FOR REALIZATION THEREOF

[76] Inventors: Anatoly A. Volkomich, Leninsky prospekt, 152, korpus 1, kv. 221, Moscow; Nikolai K. Chernyshev, Moskovskoi oblasti, shosse Entuziastov, 5, kv. 36, Balashikha; Gennady I. Bobryakov, ulitsa Velozavodskaya, 11, korpus 1, kv. 129, Moscow; Georgy M. Orlov, ulitsa Palekhskaya, 5, kv. 244, Moscow; Boris P. Blagonravov, Severny bulvar, 12, kv. 7, Moscow; Garegin S. Garibian, Malaya Semenovskaya ulitsa, 12, kv. 1407, Moscow; Nikolai I. Bekh, ulitsa Tolyatti, 4, kv. 2, Naberezhnye Chelny; Anatoly I. Yakobson, komplex 3/01, kv. 732, Naberezhnye Chelny; Vladimir I. Sivko, Moskovsky prospekt, 175, kv. 67, Naberezhnye Chelny; Adolf V. Korchin, Rogozhsky val, 15, kv. 120, Moscow; Valentin F. Mitrofanov, Klenovy bulvar, 10, korpus 3, kv. 465, Moscow; Valery A. Svechnikov, Universitetsky prospekt, 4, kv. 103, Moscow, all of U.S.S.R.

[21] Appl. No.: 656,166

[22] PCT Filed: Jun. 28, 1990

[86] PCT No.: PCT/SU90/00170

§ 371 Date: Mar. 29, 1991

§ 102(e) Date: Mar. 29, 1991

[30] Foreign Application Priority Data

Jun. 29, 1989 [SU] U.S.S.R. ..... 4705358

[51] Int. Cl.[5] ..... B22C 15/24; B22C 15/28

[52] U.S. Cl. ..... 164/7.1; 164/38; 164/160.1; 164/195

[58] Field of Search ..... 164/38, 195, 7.1, 160.1

[56] References Cited

U.S. PATENT DOCUMENTS

| | | | |
|---|---|---|---|
| 3,293,703 | 12/1966 | Taccone | 164/195 X |
| 3,880,223 | 4/1975 | Gunnergaard . | |
| 4,313,486 | 2/1982 | Kondo et al. . | |
| 4,620,584 | 11/1986 | Witt | 164/195 X |
| 4,750,540 | 6/1988 | Boenisch | 164/195 X |
| 4,791,974 | 12/1988 | Larsen | 164/195 X |

FOREIGN PATENT DOCUMENTS

| | | | |
|---|---|---|---|
| 0164731 | 12/1985 | European Pat. Off. . | |
| 61-27145 | 2/1986 | Japan | 164/38 |
| 975184 | 11/1982 | U.S.S.R. . | |
| 1060299 | 12/1983 | U.S.S.R. . | |

*Primary Examiner*—J. Reed Batten, Jr.

*Attorney, Agent, or Firm*—Jacobson, Price, Holman & Stern

[57] ABSTRACT

A molding chamber (7) accommodating pattern plates (24, 25) is supplied by a steam of air with sand mixture delivered in a direction parallel to the pattern plates (24, 25). After a time delay relative to the start of the sand delivery operation, and sand mixture is preliminarily compacted by delivering a stream of compressed air directly into the molding chamber in a direction parallel to the pattern plates, the delivery of compressed air being continued within a period of time equal to 5 to 30 percent of the duration of the sand mixture delivery operation. As a result of the delivery of compressed air, the delivery of the sand mixture is retarded and even interrupted. The stream of compressed air diverts the sand mixture in the molding chamber towards the pattern plates, thus providing a better filling of narrow deep hollows on pattern surfaces and preliminary compaction of the sand mixture. The sand delivery operation is completed after the end of the preliminary compaction. The sand mixture is finally compacted by mechanical pressing.

7 Claims, 3 Drawing Sheets

METHOD FOR PRODUCTION OF SINGLE-USE FOUNDRY MOLDS AND APPARATUS FOR REALIZATION THEREOF

FIELD OF THE INVENTION

The invention relates to foundry practice and, more particularly, to a method for the production of single-use foundry molds, and an apparatus for realization thereof.

PRIOR ART

Known in the prior art is a method for the production of single-use foundry molds (US, A 4313486), comprising the delivery of the sand mixture by the stream of air into the molding chamber accommodating a pattern plate, in the direction parallel to the pattern plate. Concurrently with its delivery, said mixture is preliminarily compacted by the stream of compressed air in the direction perpendicular to the pattern plate. The molding chamber being filled, the mixture is compacted by pressing.

This method is realized in the known apparatus (U.S. Pat. No. 4,313,486), comprising a molding chamber formed by plates arranged in pairs, viz., upper and bottom plates, side plates, pattern plate and pressing plate, a compressed air source and a means for its delivery into the molding chamber. The pattern and pressing plates have cavities and channels for the passage of air through said cavities. The upper plate has a channel for the delivery of sand mixture into the molding chamber, said mixture being delivered by the air stream in the direction parallel to the pattern plate. Concurrently, the compressed air is delivered by the molding chamber air supply unit from the compressed air source into the pressing plate cavity wherefrom it flows through pressing plate channels into the molding chamber.

Due to a pressure differential, the air is removed into the atmosphere from the molding chamber through channels of the pattern, upper and bottom plates. As a result, the air streams created in the molding chamber flow both in the vertical and horizontal directions. The horizontal streams entrain the particles of sand mixture and carry them towards the pattern plate, filling the deep hollows in the patterns.

However, said horizontal streams of air directed towards the pattern plate, perpendicularly thereto, are created by only a part of compressed air delivered through the channels of the pressing plate, the pressure of this compressed air being equal to, or somewhat lower than, the pressure of the air which forces the sand mixture into the molding chamber so that the power of the horizontal air streams is insufficient for efficient filling of narrow and deep hollows in the patterns with sand mixture and for compacting said mixture therein.

Owing to the action of the created air streams on the sand mixture, the density of said mixture is distributed irregularly throughout the volume of the molding chamber: the mixture layers adjoining the pattern plate have a maximum density while near the pressing plate the mixture has a minimum density and this leads to creation of voids in the foundry mold opposite the air channels in the pressing plate because the compressed air jets discharged from the channels interfere with the filling of these mold zones with sand mixture.

Subsequent pressing of the sand mixture by moving the pressing plate towards the pattern plate compacts the sand mixture in the layers adjoining the pressing plate; however, complete elimination of irregular distribution of mixture density throughout the volume of the mold and voids in the compressed air supply zones proves impossible.

Besides, the produced mold is difficult to extract from the molding chamber without breaking the thin protruding parts of the mold, formed by narrow and deep hollows in the pattern since the pattern plate is fixed immovably and cannot move the mold out of the molding chamber.

Thus, the known method for the production of foundry molds and the apparatus for realization thereof fail to ensure making high-quality molds of a complex configuration.

There is another method for the production of single-use foundry molds (SU, A, 1060299), consisting in that the molding chamber incorporating a pattern plate is filled with sand mixture delivered by the air stream in the direction parallel to the pattern plate. Then, on expiration of time equal to 8–60% of the duration of sand mixture supply, said mixture is preliminarily compacted by the delivery of compressed air in the direction perpendicular to the pattern plate. Final compaction of the sand mixture is performed by pressing.

The apparatus for the realization of this method comprises plates arranged in pairs and forming a molding chamber, a source of compressed air and a means for its periodical communication with the molding chamber. Four side plates arranged in pairs opposite each other are installed immovably and two more plates, the upper and bottom ones, installed movably opposite to each other with a provision for reciprocating motion have, each, a cavity and channels for the passage of air through said cavity. One of the side plates has a slot for the delivery of sand mixture into the molding chamber. The pattern plate located inside the molding chamber is installed rigidly on the bottom movable plate and has air channels arranged coaxially with the channels of said plate. The upper plate is installed above the slot for the delivery of sand mixture with a provision for moving inside the molding chamber and is provided with a means for putting the plate cavity in periodic communication with the source of compressed air.

The air stream delivers the sand mixture through the slot in the direction parallel to the pattern plate. On expiration of a time period equal to 8–60% of the duration of sand mixture delivery, compressed air is delivered from its source through the means for its periodical communication with the molding chamber into the upper plate cavity under a pressure which is higher than the air pressure for the delivery of sand mixture into the molding chamber, wherefrom it flows through the channels in the upper plate into the molding chamber in the direction perpendicular to the pattern plate.

Inasmuch as the molding chamber communicates with the atmosphere through the channels in the pattern plate and the compressed air enters the molding chamber through the channels in the upper part of the chamber, the pressure differential in the molding chamber together with the eddy currents forms the air streams directed towards the pattern plate, perpendicularly thereto.

Within the above-mentioned period of time, the molding chamber is filled with a certain amount of sand mixture which will fill the molding chamber partly from the side of the pattern plate so that the narrow deep hollows of the pattern will be partly filled with loose sand mixture. The air streams directed perpendicularly to the pattern plate will entrain particles of the sand mixture entering the molding chamber and carry them towards the pattern plate. Filtering through the layers of loose sand mixture that has entered the molding chamber before the start of delivery of compressed air, the air streams will compact the sand mixture but its density will be distributed irregularly: the maximum density will be in the mixture layers adjoining the pattern plate while the mixture layers fartbest from the pattern plate will have a minimum density.

Thus, the process of filling the molding chamber with the sand mixture and compacting the latter takes place until the upper layers of the sand mixture cover the slot for the delivery of mixture into the molding chamber. The air jets discharged from the channels interfere with the filling of the neighboring zones of the mold with the sand mixture so that voids are formed near said plate. The molding chamber having been filled with the sand mixture, the upper plate is moved towards the pattern plate, thus compacting the sand mixture by pressing. Pressing compacts the mixture near the upper plate and raises somewhat the uniformity of mixture distribution throughout the mold volume but fails to eliminate voids in its zone opposite the compressed air delivery channels near the pressing plate. After pressing, the bottom plate with the pattern plate secured thereto is brought down, thus extracting the pattern from the foundry mold.

The known method and apparatus for realization thereof fail to produce high-quality foundry molds of a complex configuration.

Besides, during extraction of patterns from the mold, the high and thin parts of said mold are often broken due to their insufficient strength which is caused by insufficient density of these parts of the mold.

SUMMARY OF THE INVENTION

The main object of the invention is to provide a method for the production of single-use foundry molds and an apparatus for realization thereof wherein uniform compaction of the sand mixture throughout the mold volume and the design of the apparatus would ensure the production of high-quality foundry molds of a complex configuration.

This object is achieved in the method for the production of single-use foundry molds comprising delivery of sand mixture by an air stream into the molding chamber incorporating a pattern plate in the direction parallel to the pattern plate and, on expiration of a time period equal to about 6–60% of the duration of mixture delivery, preliminary compaction of said mixture by compressed air then its final compaction by pressing wherein, according to the invention, the air begins to be discharged from the molding chamber before the beginning and in the course of sand mixture delivery in the direction perpendicular to the pattern plate and this discharge of air ends concurrently with the end of mixture delivery, the compressed air being delivered into the molding chamber in the direction parallel to the pattern plate and this delivery ending before the end of delivery of the sand mixture.

The air shall be discharged from the molding chamber before filling it with the sand mixture in order to create therein intensive horizontal air streams directed towards the pattern plate, perpendicularly thereto.

In the course of mixture delivery into the molding chamber said horizontal air streams deflect the sand mixture towards the pattern plate which contributes to its better penetration into the narrow deep hollows of the pattern.

The necessity for delivery of compressed air into the molding chamber in the direction parallel to the pattern plate is caused by the fact that the streams of compressed air of said direction interacting with the streams of air directed towards the pattern plate, perpendicularly thereto, ensure compaction of the sand mixture in the narrow deep hollows of patterns and uniform compaction of said mixture throughout the volume of the mold.

It is practicable that the discharge of the air from the molding chamber should being 0.1–1 s before the beginning of mixture delivery.

This method of air discharge from the molding chamber is required in order to create reliable motion of air streams towards the pattern plate. The time period shorter than 0.1 s is insufficient for forming the steady streams of air perpendicular to the pattern plate while the period exceeding 1 s before the delivery of sand mixture is uneconomical.

It is recommended that the delivery of compressed air into the molding chamber should be continued within the time period equal to about 5–30% of the duration of sand mixture delivery.

The delivery into the molding chamber of compressed air in the direction parallel to the pattern plate improves the filling of narrow deep hollows in the patterns with sand mixture and its preliminary compaction.

However, this process goes together with the rise of air pressure in the molding chamber which retards, or even may stop, the delivery of sand mixture. Therefore, the delivery of compressed air into the molding chamber should be stopped before the end of sand mixture delivery.

Said duration limits of compressed air delivery into the molding chamber are the optimum ones since, if the duration of air delivery is less than 5% of the duration of mixture delivery, the effect of said air is insufficient while the duration exceeding 30% will prevent the sand mixture from filling the hard-to-get-at points of the patterns because within the remaining mixture delivery time will be insufficient for delivering the required amount of sand mixture into the molding chamber.

It is also recommended to deliver compressed air in meeting currents.

Said method of compressed air delivery is practicable when using large-size molding chambers.

This object is also achieved by providing an apparatus for realization of the method for the production of single-use foundry molds comprising plates arranged in pairs and constituting a molding chamber; the two side plates, arranged opposite each other being installed immovably while the two other counteropposed plates are installed movably with a provision for reciprocating motion, each plate having a cavity and channels for the passage of air through said cavity while one of the remaining plates has a slot for the delivery of said mixture into the molding chamber which incorporates a pattern plate rigidly mounted on one of the movable plates and has air channels arranged coaxially with the channels of said plate, a source of compressed air and a means for its periodical communication with the molding chamber wherein, according to the invention, the apparatus has an air discharge system periodically communicated with the molding chamber, and at least one additional plate rigidly secured on the outside to the fixed side plate and provided at the side of the latter with a hollow which, together with said fixed plate, forms an air chamber, the additional plate having a means for the delivery of compressed air into the air chamber, said means communicating with the compressed air source and said fixed side plate has channels for the delivery of compressed are through the air chamber into the molding chamber.

It is practicable that the molding chamber should incorporate an additional pattern plate rigidly installed on another movable plate and having channels arranged coaxially with the channels of said movable plate.

Such a structural arrangement of the apparatus for the realization of the method for the production of single-use foundry molds provides for the realization of the method permitting the air to be discharged from the molding chamber due to a provision in the apparatus of an air discharge system which ensures uniform compaction of sand mixture in the volume of the mold.

Besides, the provision in the apparatus of at least one additional plate having a means for delivery of compressed air into the air chamber wherefrom is, flows into the molding chamber ensures the air delivery into the molding chamber in the direction parallel to the pattern plate which improves the filling of narrow deep hollows in the patterns with sand mixture and its preliminary compaction.

The provision in the molding chamber of an additional pattern plate ensures the possibility of making high-quality two-sided foundry molds of a complex configuration.

Thus, the above-stipulated conditions for the method for the production of single-use molds and the design of the apparatus for realization thereof ensure uniform compaction with sand mixture of narrow deep spaces in the mould which improves the quality of the molds of a complex configuration and the possibility of making single-use two-sided foundry molds.

BRIEF DESCRIPTION OF THE DRAWINGS

For a better understanding of the invention given below are its concrete examples with reference to the appended drawings, in which.

DETAILED DESCRIPTION OF THE PREFERRED EMBODIMENT

The method for the production of foundry molds is realized as follows.

0.1–1 s before the delivery of sand mixture into the molding chamber provided with a pattern plate, the air is discharged from said chamber in order to create intensive horizontal air streams therein. The air is discharged in the direction perpendicular to the pattern plate. Then, the sand mixture is delivered by the air stream into the molding chamber in the direction parallel to the pattern plate and, upon expiration of a period of time equal to about 8–60% of the duration of sand mixture delivery, said mixture is preliminarily compacted by compressed air. The compressed air is delivered into the molding chamber in the direction parallel to the pattern plate within the period of time equal to about 5–30% of the duration of mixture delivery, i.e. the delivery of compressed air is completed before the end of sand mixture delivery.

The air continues to be discharged from the molding chamber in the course of mixture delivery and said discharge ends concurrently with the end of mixture delivery. Then, the sand mixture is compacted by pressing.

Figure 1:
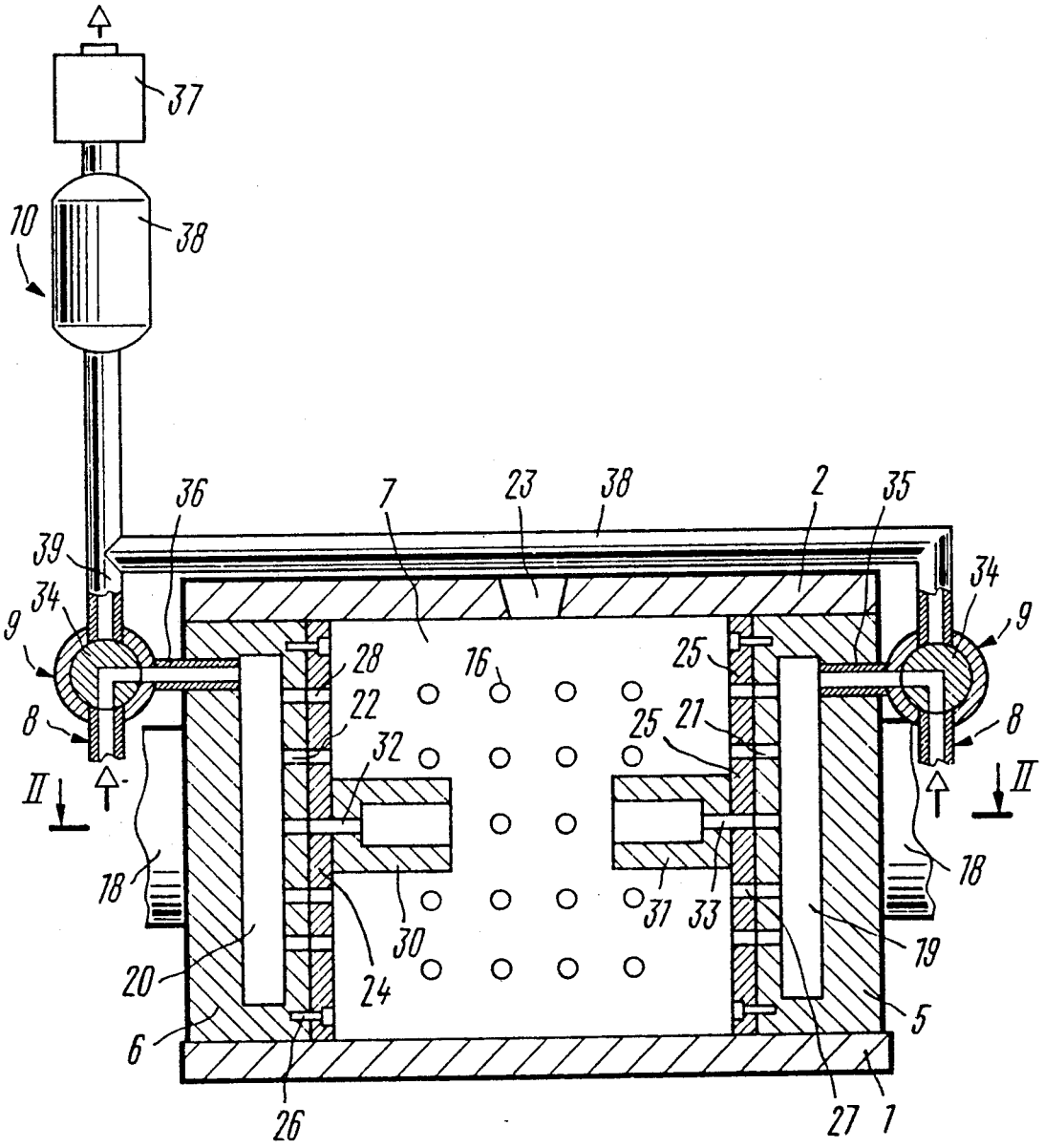
FIG. 1 is a schematic diagram of the apparatus for realization of the method for the production of single-use foundry molds, according to the invention, front view, longitudinal section.
Figure 2:
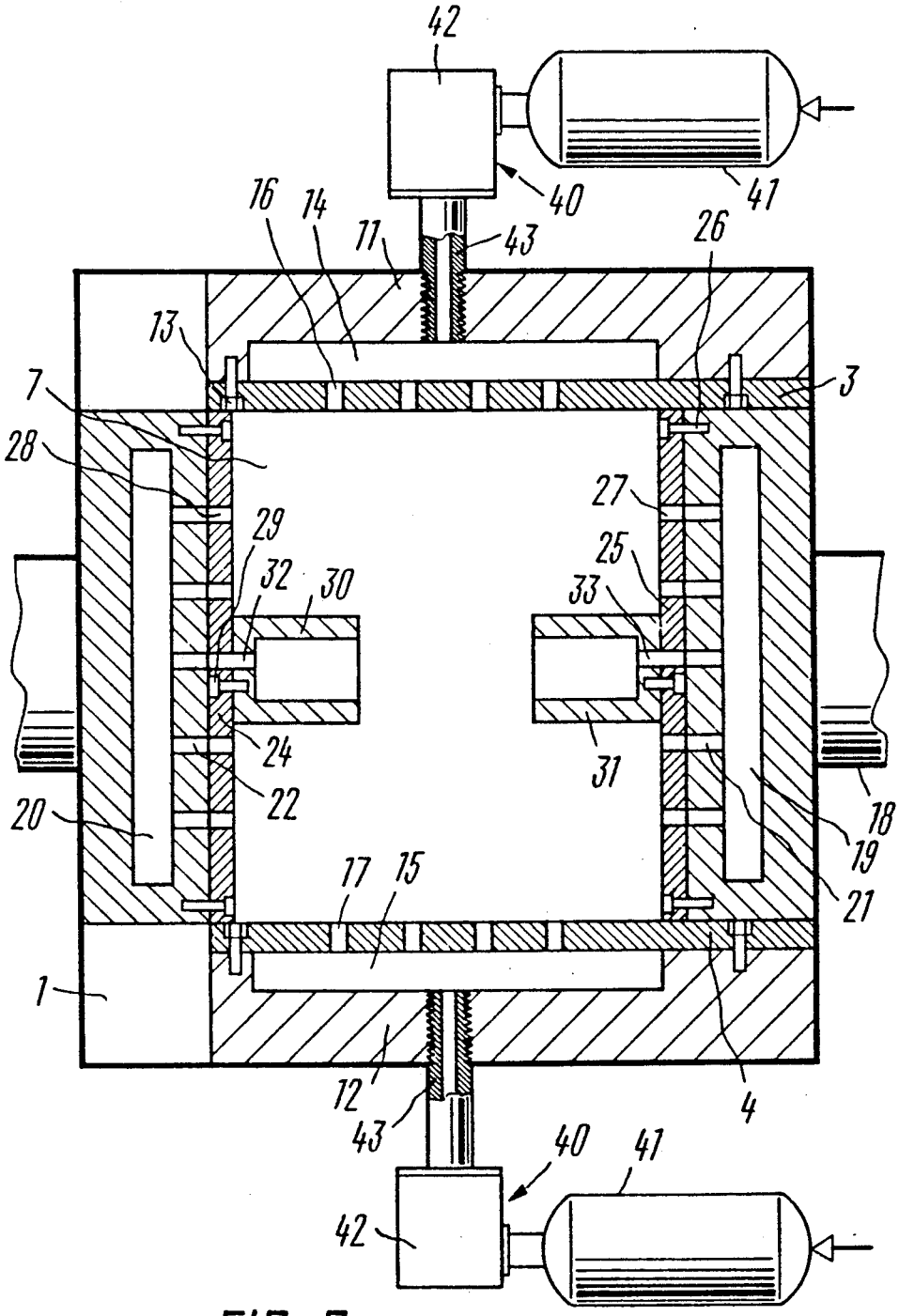
FIG. 2—section II in FIG. 1.

The apparatus for the realization of the method for the production of single-use foundry molds comprises pairwise arranged plates 1, 2 (FIG. 1), 3, 4 (FIG. 2), 5, 6 (FIG. 1) which form the molding chamber 7, a source of compressed air 8, a means for putting said source in periodic communication with the molding chamber 7, and a system 10 for the discharge of air from the molding chamber 7. Two side plates 3, 4 (FIG. 2) arranged opposite each other are immovable.

The apparatus is provided with at least one additional plate and the number of such plates is selected in accordance with the overall dimensions of the molding chamber 7 and may reach four. In this case, said additional plates may be installed on plates 1, 2 (FIG. 1), 3, 4 (FIG. 2), respectively.

In the embodiment of the invention considered here the apparatus is provided with two additional plates 11, 12 secured rigidly from outside to the fixed side plates 3, 4 with bolts 13. Each additional plate 11, 12 has a hollow at the side of the corresponding plate 3, 4, said hollow and said plate forming an air chamber 14, 15. The plates 3, 4 have channels 16, 17 for the delivery of compressed air through the corresponding air chambers 14, 15 into the molding chamber 7.

Two counteropposed plates 5, 6 (FIG. 1) are installed movably with a provision for reciprocating motion and each of them is connected with the rod 18 of the hydraulic cylinder (not shown in the Drawings).

Each movable plate 5, 6 is provided with respective cavities 19, 20 and respective channels 21, 22 for the passage of air through the respective cavity 19, 20. The plate 2 installed movably opposite the plate 1 has a slot 23 for the delivery of mixture into the molding chamber 7, said mixture entering the slot 23 from the sand-blasting tank (not shown in the Drawing).

Arranged inside the molding chamber 7 are two pattern plates 24, 25 fastined rigidly by bolts 26 on the movable plates 5, 6. Each pattern plate 24, 25 has respective air channels 27, 28 arranged coaxially with channels 21, 22. Secured with bolts 29 to the pattern plates 24, 25 (FIG. 2) are patterns 30, 31, respectively. Each pattern 30, 31 has a respective channel 32, 33 arranged coaxially to the corresponding channels 27, 28 of the corresponding pattern plate 24, 25.

The means 9 (FIG. 1) for putting the compressed air source 8 periodically in communication with the molding chamber 7 is made in the form of a cock 34 and pipelines 35, 36 communicating with the cavities 19, 20. Connected to the cock 34 is a system 10 for the discharge of air from the molding chamber 7 constituting by a vacuum pump 37 communicating with a vacuum tank 38. The discharge system 10 is put periodically in communication with the cock through the pipeline 39. The cock 34 is capable of communicating periodically with the compressed air source 8 with the air discharge system 10. Each additional plate 11, 12 (FIG. 2) is provided with a means 40 for delivering compressed air into a respective air chamber 14, 15. The means 40 is, essentially, a compressed air tank 41 communicating with a valve 42 and, through a pipeline 43, with the respective air chambers 14, 15.

The apparatus for the realization of the method for the production of single-use foundry molds, according to the invention, functions as follows.

The cavities 19, 20 are put in communication by the cock 34 (FIG. 1) through pipelines 35, 36 with the air discharge system 10 creating a pressure differential between the cavities 19, 20 and the moulding chamber 7 so that the air is discharged from the molding chamber 7 through channels 27, 28 and 21, 22 in the direction perpendicular to the pattern plates 24, 25. The discharge of air in the direction perpendicular to the pattern plates 24, 25 is required for creating steady air streams in the molding chamber 7 directed towards the pattern plates 24, 25, perpenducularly thereto. Inasmuch as the air is an inertia medium, the creation of steady air streams of the required direction takes a certain period of time so that the discharge of air has to begin before the start of sand mixture delivery into the molding chamber 7. In the considered example, the discharge of air from the molding chamber is started 0.5 s before the beginning of mixture delivery. Generally speaking, this time period may range from 0.1 to 1 s because the time period shorter than 0.1 s is insufficient for creating the steady air streams perpenducular to the pattern plates while the discharge of air started more than 1 s before the delivery of sand mixture is uneconomical since the stream have already been reliably formed so that the energy of the discharge of air is expended for nothing. Besides, this increases the total time of the mold production cycle thus reducing the efficiency of the apparatus.

After the air streams directed towards and perpendicularly to the pattern plates 24, 25 have been reliably formed, the sand mixture is delivered after said time interval (0.5 s) through the slot 23 by the air stream into the molding chamber 7 in the direction parallel to the pattern plates 24, 25. The particles of sand mixture moving in the air stream parallel to the pattern plates 24, 25 are carried by the air streams directed towards and perpenducularly to the pattern plates 24, 25, filling the narrow deep hollows of the patterns 30, 31. In order to secure this movement of mixture particles within the entire process of filling the molding chamber 7, the air has to be discharged in the above-specified direction up to the completion of delivery of sand mixture into the molding chamber 7.

After a period of time equal to about 8–60% of the time of delivery of the sand mixture, said mixture is preliminarily compacted by compressed air. In the embodiment discussed herein this period of time is taken to be 10% of the mixture delivery duration. Compressed air is supplied through pipelines 43 (FIG. 2) into the air chambers 14, 15 wherefrom it flows through channels 16, 17 into the molding chamber 7 in the direction parallel to the pattern plates 24, 25. Compressed air is delivered under a pressure somewhat higher than the pressure of air used for the delivery of sand mixture, the compressed air being delivered in meeting streams through two additional plates 11, 12.

If the apparatus has one additional plate which is expedient in the case of a small-volume molding chamber, the compressed air is delivered in one stream directed parallel to the pattern plates.

However, the compressed air stream may be delivered either from two sides (meeting streams) into small molding chambers or from one side (a single stream) into large-size molding chambers. In the latter case, it becomes necessary to increase the cross-sectional areas of the means 40 for the delivery of compressed air and to increase the compressed air pressure.

Compressed air is delivered into the molding chamber 7 in the direction parallel to the pattern plates 24, 25 because the air streams moving in this direction interact with the air streams directed towards the pattern plates 24, 25, perpendicularly thereto, and thus ensure compaction of the sand mixture in the narrow deep hollows of the patterns 30, 31 and uniform compaction of the mixture throughout the volume of the foundry mold, except the zones near the plates whose channels 16, 17 admit compressed air into the chamber 7.

In case of any other direction of compressed air stream, there appear air streams in the chamber 7, directed against the air streams which carry the sand mixture towards the pattern plates 24, 25 and, consequently, interfere with filling the narrow deep hollows or patterns 30, 31 with sand mixture, thus imparing the quality of foundry molds.

Compaction of the sand mixture reduces its volume and the jets of the air delivered into the molding chamber 7 interfere with filling the compressed air delivery zones with sand mixture so that there appear voids and looseness near the plates 3, 4 whose channels 16, 17 deliver the compressed air; said voids can be filled only by stopping the delivery of compressed air before the end of mixture delivery into the molding chamber 7. Within the time between the end of air delivery and the end of mixture delivery the sand mixture entering the molding chamber 7 will freely fill these voids and will be compacted there, ensuring uniform distribution of density throughout the volume of the foundry mold. Thus, the compressed air must be delivered into the molding chamber within the time period equal to 5–30% of the duration of mixture delivery into the molding chamber 7, i.e. the duration of air delivery should be smaller than the time of mixture delivery. When the time of air delivery is 5% less than the mixture delivery time, the effect of action of air is insufficient while in case of air delivery time longer than 30% it will be not enough for the mixture to fill the voids because within the remaining time of its delivery the molding chamber 7 will not receive the required amount of mixture.

In the described example, the compressed air is delivered into the chamber 7 within the period equal to 20% of the duration of mixture delivery in the direction parallel to the pattern plates 24, 25.

As soon as the molding chamber 7 has been filled with the sand mixture, its delivery through the slot 23 (FIG. 1) is discontinued simultaneously stopping the discharge of air from the molding chamber 7. For this purpose the cavities 19, 20 are disconnected from the air discharge system 10 by means of the cock 34. The plates 5 and 6 are moved towards each pther, compacting the sand mixture finally by pressing. Then, the cock 34 puts the cavities 19, 20 in communication with the compressed air source 8 and simultaneously the plates 5 and 6 are moved away from each other, extracting the patterns 30, 31 from the mold. Compressed air delivered through channels 21, 22, 27, 28 creates the air streams directed perpendicularly to the pattern plates 24, 25 towards the mold and ensuring easy extraction of patterns 30, 31 from the mold without breakage of their high and thin parts.

EXAMPLE 1

0.1 s before the beginning of mixture delivery, the air is discharged from the molding chamber in the direction perpendicular to the pattern plates and continues to be discharged also during the delivery of sand mixture.

The sand mixture consisting of, wt %:

| | |
|---|---|
| bentonite | 10 |
| amylomite | 0.2 |
| quartz sand | the balance |

is delivered by the stream of air under a pressure of 0.3 MPa into a molding chamber having two pattern plates in the direction parallel to said plates. Sand mixture characteristics: compression strength 0.15 MPa, rupture strength 0.016 MPa, moisture content 3–3.5%.

Duration of mixture delivery is 1 s. Then, the mixture is preliminarily compacted by the compressed air delivered in the direction parallel to the pattern plates. This compressed air is delivered by the meeting streams 0.5 s after the mixture delivery (which amounts to 50% of the duration of mixture delivery) and in the course of 0.2 s (20% of the duration of mixture delivery).

Then, the sand mixture is compacted by pressing at a force of 10 kgf/cm$^2$.

Now, the compressed air is delivered through the pattern plates, concurrently withdrawing them from the mold and extracting the patterns.

The results of twenty two similar experiments conducted under similar conditions are summarized in Table 1.

Figure 3:
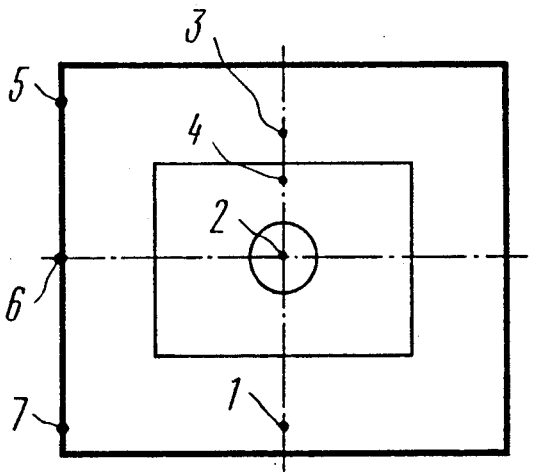
FIG. 3 is a schematic diagram of the foundry mold produced by the claimed method in the apparatus illustrated in FIGS. 1, 2, front view.
Figure 4:
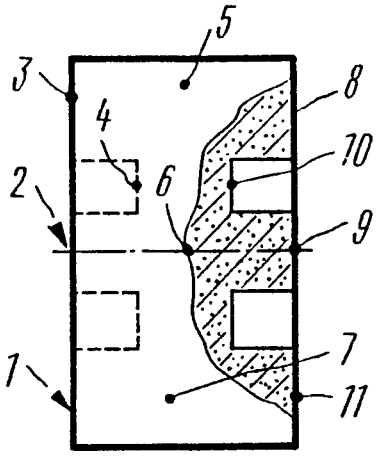
FIG. 4 is the same mold as shown in FIG. 3, with partial cutaway section, left-hand view.

A criterion for assessing the standard of compaction is the hardness parameter, determined with a hardness meter. The surface hardness of the mold is determined in points 1 through 11 shown in the mold diagram in FIGS. 3 and 4.

The results of tests are given in Table 2.

The disclosed method for the production of foundry molds and the apparatus for realization thereof ensure the high-quality impression of the patterns on both sides of the foundry mold, high efficiency of production by mating two-sided molds of a complex configuration in a single molding chamber and a considerable broadening of nomenclature of castings produced by flaskless horizontal stack molding in automatic production lines.

INDUSTRIAL APPLICABILITY

Most successfully this invention can be utilized in automatic flaskless molding lines in the production of castings of complex configuration.

TABLE 1

| Example No. 1 | Chamber overall dimensions, mm 2 | Air discharge from chamber, s 3 | Preliminary compaction of sand mixture: time before delivery of sand mixture, % 4 | time before delivery of sand mixture, s 5 | duration of mixture delivery, % 6 | duration of mixture delivery, s 7 |
|---|---|---|---|---|---|---|
| 1 | 250 × 250 × 250 | 0.05 | 30 | 0.12 | 20 | 0.8 |
| 2 | 250 × 250 × 250 | 0.1 | 30 | 0.12 | 20 | 0.8 |
| 3 | 250 × 250 × 250 | 0.5 | 30 | 0.12 | 20 | 0.8 |
| 4 | 250 × 250 × 250 | 1.0 | 30 | 0.12 | 20 | 0.8 |
| 5 | 250 × 250 × 250 | 1.5 | 30 | 0.12 | 20 | 0.8 |
| 6 | 250 × 250 × 250 | 0.5 | 7 | 0.028 | 20 | 0.8 |
| 7 | 250 × 250 × 250 | 0.5 | 8 | 0.032 | 20 | 0.8 |
| 8 | 250 × 250 × 250 | 0.5 | 40 | 0.16 | 20 | 0.8 |
| 9 | 250 × 250 × 250 | 0.5 | 60 | 0.24 | 20 | 0.8 |
| 10 | 250 × 250 × 250 | 0.5 | 65 | 0.26 | 20 | 0.8 |
| 11 | 250 × 250 × 250 | 0.5 | 40 | 0.32 | 4 | 0.016 |
| 12 | 250 × 250 × 250 | 0.5 | 40 | 0.32 | 5 | 0.02 |
| 13 | 250 × 250 × 250 | 0.5 | 40 | 0.32 | 20 | 0.08 |
| 14 | 250 × 250 × 250 | 0.5 | 40 | 0.32 | 30 | 0.12 |
| 15 | 250 × 250 × 250 | 0.5 | 40 | 0.32 | 35 | 0.14 |
| 16 | 250 × 250 × 250 | 0.5 | 40 | 0.32 | 20 | 0.08 |
| 17 | 250 × 250 × 250 | 0.5 | 40 | 0.32 | 20 | 0.08 |
| 18 | 250 × 250 × 250 | 0.5 | 40 | 0.32 | 20 | 0.08 |
| 19 | 250 × 250 × 250 | 0.5 | 40 | 0.32 | 20 | 0.08 |
| 20 | 250 × 250 × 250 | 0.5 | 40 | 0.32 | 20 | 0.08 |
| 21 | 250 × 250 × 250 | 0.5 | 40 | 0.32 | 20 | 0.08 |
| 22 | 900 × 700 × 700 | 0.5 | 40 | 0.32 | 20 | 0.08 |

| Example No. 1 | Duration of mixture delivery, s 8 | Pressing force, kgf/cm$^2$ 9 | Relation of depth to width of pattern hollow 10 |
|---|---|---|---|
| 1 | 0.4 | 10 | 2.0 |
| 2 | 0.4 | 10 | 2.0 |
| 3 | 0.4 | 10 | 2.0 |
| 4 | 0.4 | 10 | 2.0 |
| 5 | 0.4 | 10 | 2.0 |
| 6 | 0.4 | 10 | 2.0 |
| 7 | 0.4 | 10 | 2.0 |
| 8 | 0.4 | 10 | 2.0 |
| 9 | 0.4 | 10 | 2.0 |
| 10 | 0.4 | 10 | 2.0 |
| 11 | 0.4 | 10 | 2.0 |
| 12 | 0.4 | 10 | 2.0 |
| 13 | 0.4 | 10 | 2.0 |
| 14 | 0.4 | 10 | 2.0 |
| 15 | 0.4 | 10 | 2.0 |
| 16 | 0.4 | 10 | 0.1 |
| 17 | 0.4 | 10 | 0.3 |
| 18 | 0.4 | 10 | 1.0 |
| 19 | 0.4 | 10 | 3.0 |
| 20 | 0.4 | 10 | 3.5 |
| 21 | 0.4 | 10 | 2.0 |
| 22 | 0.4 | 10 | 2.0 |

TABLE 2

| | Surface hardness in points, units: 1 | 2 | 3 | 4 | 5 | 6 | 7 | 8 | 9 | 10 | 11 | Remarks |
|---|---|---|---|---|---|---|---|---|---|---|---|---|
| 1. | 85 | 40 | 80 | 85 | 80 | 82 | 82 | 80 | 40 | 85 | 85 | Loosely-compacted thin protruding parts of mold |
| 2. | 85 | 83 | 85 | 85 | 83 | 85 | 87 | 85 | 83 | 88 | 88 | Molds of good quality |
| 3. | 85 | 85 | 85 | 85 | 85 | 85 | 85 | 85 | 85 | 85 | 85 | Same |
| 4. | 87 | 86 | 87 | 85 | 85 | 86 | 85 | 86 | 85 | 87 | 88 | Same |
| 5. | 87 | 86 | 85 | 86 | 85 | 85 | 85 | 86 | 86 | 87 | 88 | Impracticable conditions |
| 6. | 88 | 70 | 75 | 80 | 70 | 75 | 83 | 75 | 70 | 80 | 88 | Molds of nonuniform density |
| 7. | 85 | 85 | 85 | 85 | 83 | 85 | 87 | 85 | 83 | 88 | 88 | Molds of good quality |
| 8. | 85 | 85 | 85 | 85 | 84 | 85 | 85 | 85 | 84 | 85 | 85 | Same |
| 9. | 85 | 85 | 85 | 85 | 85 | 84 | 85 | 84 | 85 | 85 | 85 | Same |
| 10. | 85 | 75 | 80 | 85 | 50 | 0 | 70 | 75 | 50 | 70 | 80 | Voids and looseness |
| 11. | 85 | 85 | 85 | 85 | 65 | 0 | 75 | 85 | 85 | 85 | 85 | Same |
| 12. | 85 | 85 | 85 | 85 | 85 | 85 | 85 | 85 | 85 | 85 | 85 | Molds of good quality |
| 13. | 86 | 85 | 86 | 86 | 87 | 85 | 86 | 85 | 85 | 85 | 85 | Same |
| 14. | 86 | 86 | 85 | 85 | 86 | 80 | 86 | 85 | 85 | 86 | 86 | Same |
| 15. | 86 | 86 | 86 | 86 | 70 | 0 | 76 | 85 | 86 | 85 | 86 | Voids and looseness |
| 16. | 86 | 85 | 86 | 86 | 85 | 85 | 86 | 85 | 86 | 86 | 86 | Molds of good quality |
| 17. | 86 | 85 | 86 | 85 | 85 | 85 | 86 | 85 | 86 | 86 | 86 | Same |
| 18. | 86 | 80 | 86 | 85 | 85 | 85 | 86 | 85 | 80 | 86 | 86 | Same |
| 19. | 86 | 78 | 86 | 85 | 85 | 85 | 86 | 85 | 78 | 86 | 86 | Same |

TABLE 2-continued

| | Surface hardness in points, units | | | | | | | | | | | |
|---|---|---|---|---|---|---|---|---|---|---|---|---|
| | 1 | 2 | 3 | 4 | 5 | 6 | 7 | 8 | 9 | 10 | 11 | Remarks |
| 20. | 86 | 40 | 86 | 85 | 85 | 85 | 86 | 85 | 40 | 86 | 86 | Loosely-compacted thin protruding parts of mold |
| 21. | 86 | 86 | 86 | 85 | 85 | 85 | 86 | 85 | 86 | 86 | 86 | Molds of good quality |
| 22. | 85 | 87 | 86 | 85 | 86 | 86 | 87 | 85 | 86 | 86 | 86 | Same |

We claim:

1. A method for producing single-use foundry molds comprising the steps of:

pneumatically delivering a sand mixture into a molding chamber having at least one pattern plate, in a direction of movement of said sand mixture parallel to said at least one pattern plate;

delivering at least one unidirectional stream of compressed air directly into said molding chamber in order to thereby produce a preliminary compaction of said sand mixture, said step of delivering said at least one unidirectional stream of compressed air being initiated with a time delay relative to the initiation of said step of pneumatically delivering said sand mixture;

finally compacting said sand mixture by mechanical pressing: characterized in that said step of delivering said at least one unidirectional stream of compressed air directly into said molding chamber to thereby produce a preliminary compaction of said sand mixture is performed within a predetermined period of time;

said step of delivering compressed air causes a retardment and interruption of said step of pneumatically delivering said sand mixture; and said step of pneumatically delivering said sand mixture is completed after the termination of said step of delivering compressed air.

2. A method as claimed in claim 1, wherein said step of delivering compressed air into said molding chamber in order to thereby produce a preliminary compaction of said sand mixture is continued for a time period equal to 5–30 percent of the duration of said step of pneumatically delivering said sand mixture.

3. A method as claimed in claim 1, wherein said compressed air is delivered into said molding chamber in a direction parallel to said pattern plate.

4. A method as claimed in claim 1, wherein said compressed air is delivered into said molding chamber in a direction parallel to said pattern plate and perpendicular to said direction of movement of said sand mixture.

5. A method as claimed in claim 1, wherein said compressed air is delivered into said molding chamber in two meeting streams.

6. A method as claimed in claim 1, further comprising the step of discharging air from said molding chamber, said step of discharging air preceding said step of pneumatically delivering said sand mixture into said molding chamber and being terminated concurrently with the end of said step of sand mixture delivery.

7. An apparatus for producing single-use foundry molds comprising:

a molding chamber (7), said molding chamber having a bottom plate (1), a top plate (2), a first and a second oppositely disposed immovable side plates (3, 4), a first and a second oppositely disposed reciprocatingly movable side plates (5, 6), a slot (23) for delivering a sand mixture into said molding chamber, said slot being provided in said top plate, a cavity (19, 20) and channels (21, 22) for the passage of air, said cavity and said channels being located in each one of said first and second movable side plates, at least one pattern plate (24) rigidly installed on one of said movable side plates, and air ducts (28) located in said at least one pattern plate coaxially with said channels (22) for the passage of air;

a source (8) of compressed air;

means (9) for putting said source of compressed air periodically into communication with the molding chamber; and an air discharge system (10) periodically put into communication with said molding chamber (7); characterized in that said molding chamber includes:

at least one additional plate (11) rigidly secured to an outer side of said first immovable plate (3), said at least one additional plate having a hollow forming with the first immovable side plate an air chamber (14), and air passages (16) located in said first immovable side plate, said air passages communicating said air chamber with said molding chamber; and wherein said apparatus further comprises means (4) communicating said air chamber with said compressed air source (8).

* * * * *